US005778611A

United States Patent [19]

Michel

[11] Patent Number: 5,778,611

[45] Date of Patent: Jul. 14, 1998

[54] VENT EXTENSION FLASHING ASSEMBLY

[76] Inventor: Daniel Michel, 1930 S. Club Dr., Wellington, Fla. 33414

[21] Appl. No.: 770,504

[22] Filed: Dec. 20, 1996

[51] Int. Cl.[6] ..... E04H 12/28

[52] U.S. Cl. ..... 52/198; 52/58; 52/62; 52/219; 52/244; 285/43; 285/331; 454/3

[58] Field of Search ..... 52/219, 244, 198, 52/58, 62; 285/43, 331; 454/3

[56] References Cited

U.S. PATENT DOCUMENTS

| | | | |
|---|---|---|---|
| 2,592,084 | 7/1952 | Van Alstyne . | |
| 3,436,880 | 4/1969 | Kifer | 52/219 X |
| 3,603,340 | 9/1971 | Rousselet | 52/198 X |
| 3,797,181 | 3/1974 | Nievelt | 52/219 X |
| 3,874,138 | 4/1975 | Storch | 52/219 X |
| 4,115,961 | 9/1978 | Bishop . | |
| 4,372,585 | 2/1983 | Evora . | |
| 4,524,262 | 6/1985 | Meyer | 52/219 X |

FOREIGN PATENT DOCUMENTS 421131 12/1934 United Kingdom .

*Primary Examiner*—Christopher Kent
*Attorney, Agent, or Firm*—Sixbey, Friedman, Leedom & Ferguson; Daniel W. Sixbey

[57] ABSTRACT

A vent extension flashing assembly having a tubular outside vent stack cover which is secured to a substantially flat roof flashing base plate. The tubular outside vent cover has a diameter larger than the vent pipe to be covered by the vent extension flashing assembly. The assembly includes a tubular inner vent stack cover positioned within the tubular outer vent cover, wherein the tubular inner vent cover includes a diameter smaller than that of the covered vent pipe so as to fit within the covered vent pipe. When the assembly is positioned over the vent pipe, the vent pipe extends between the tubular outer vent cover and the tubular inner vent cover. A rigid expandable portion is formed on the innermost end of the inner vent cover and is capable of being expanded by a cam member to engage an inner surface of the vent pipe to hold the inner vent cover in place within the vent pipe. A tamperproof cap covers the outer end of the assembly extending around the outer surface of the tubular outer vent cover, and the cap is held in place by a plurality of pressure set screws.

7 Claims, 3 Drawing Sheets

VENT EXTENSION FLASHING ASSEMBLY

TECHNICAL FIELD

The present invention relates generally to an apparatus for covering a roof vent stack and more particularly to an improved vent extension flashing assembly for providing a tamper-proof covering for the vent stack.

BACKGROUND OF THE INVENTION

It is customary in the plumbing industry to have vent pipes extending through the roof of a building to provide a vent passage for gases produced inside the building. The opening in the roof through which the vent pipe extends is then sealed with a flashing mounted upon the roof of the building. The standard flashing includes a base portion that extends parallel to the roof of the building that surrounds the vent pipe. Therefore, the flashing covers the opening in the roof to provide a watertight seal around the vent pipe preventing external elements from traveling between the roof and the vent pipe.

In order to secure the flashing around the vent pipe, usually the base portion of the flashing is adhered to the roof of the building. In some instances, a sleeve protector is secured to the flashing base portion to surround the vent pipe. U.S. Pat. No. 4,372,585 issued to Evora discloses a sleeve protector for venting pipes having a tubular member which surrounds the venting pipe and a flat portion which follows the slope of the roof. Here, the flat portion of the sleeve protector is attached to the roof using asphalt or other glue compounds to ensure water tightness between the sleeve protector and the roof. However, when adhesive or asphalt is the sole means for securing the sleeve protector, it can work loose as the bond with the roof deteriorates. Therefore, there is a need for an improved manner of securing a vent extension flashing assembly which overcomes the disadvantages associated with adhesives.

It is also possible to attach a vent pipe sleeve protector to the outside surface of the vent pipe which it surrounds. However, such attachments are generally easily removable by unwanted individuals. The use of a removable flashing assembly adds the necessity to guard against tampering or theft of the flashing assemblies in situations where tampering or theft is possible. Little attention has been given to the development of flashings for vent pipes having tamper-proof or vandal proof designs. Such flashings should be difficult for unwanted persons to remove in order to deter tampering with vent pipe or flashing and to deter theft of the flashing.

Furthermore, building codes customarily require that vent pipes extend a certain distance above the roof. When a sleeve protector is attached around the vent pipe, it is also necessary for the sleeve protector to comply with these distances. Therefore, the sleeve protectors must be carefully fitted with the specific vent pipe covered to ensure the predetermined distances required are complied with. When rebuilding the surface of a roof, it is often necessary to attach extensions to or remove portions of the pre-existing vent pipe to achieve the necessary distance above the roof. Accordingly, there is a need for a vent extension flashing assembly which can be inserted into any preexisting vent pipe without the need to modify the vent pipe in order to comply with the building code distance requirements.

SUMMARY OF THE INVENTION

It is a primary object of the present invention to overcome the aforementioned shortcomings associated with the prior art.

Another object of the present invention is to provide a novel vent extension flashing assembly for covering portions of both the interior and exterior of a rooftop vent pipe which is easily attached to the vent pipe.

A further object of the present invention is to provide a novel vent extension flashing assembly having a vandal-proof and tamper-proof design which is secured to both the interior and exterior surfaces of the vent pipe.

Yet a further object of the present invention is to provide a novel vent extension flashing assembly for covering a rooftop vent pipe which attaches the inner surface of the vent pipe and which includes an adjustable cam operated attachment unit.

Still another object of the present invention is to provide a novel vent extension flashing assembly which can be inserted into any pre-existing vent pipe where the top of the vent extension flashing assembly extends the same distance above the roof surface no matter what distance the vent pipe protrudes from the roof.

These as well as additional objects and advantages of the present invention are achieved by providing a vent extension flashing assembly having a tubular outside vent stack cover which is secured to a substantially flat base sheet. The tubular outside vent cover has a diameter larger than the vent pipe to be covered by the vent extension flashing assembly. The assembly further includes a tubular inner vent stack flashing positioned within the tubular outer vent cover, and the tubular inner vent stack cover has a diameter smaller than the covered vent pipe so as to fit within the covered vent pipe. When the assembly is positioned over the vent pipe, the vent pipe extends between the tubular outer vent cover and the tubular inner vent cover. Expandable portions are formed on the innermost end of the inner vent cover, and these expandable portions are capable of being expanded by cam members to engage an inner surface of the vent pipe to hold the vent extension flashing assembly in place relative to the vent pipe. A pair of take-up bolts attached to the cam member are provided on an outer end of the assembly and extend along the inner surface of the inner vent cover. The position of the take-up bolts can be adjusted to control the amount of expansion of the expandable portions of the inner vent cover. A vandal-proof cap covers the outer end of the assembly extending around the outer surface of the tubular outer vent cover, and the cap is held in place by a plurality of pressure set screws.

These as well as additional advantages of the present invention will become apparent from the following description of the invention with reference to the several figures.

DETAILED DESCRIPTION OF THE PREFERRED EMBODIMENT

Figure 1:
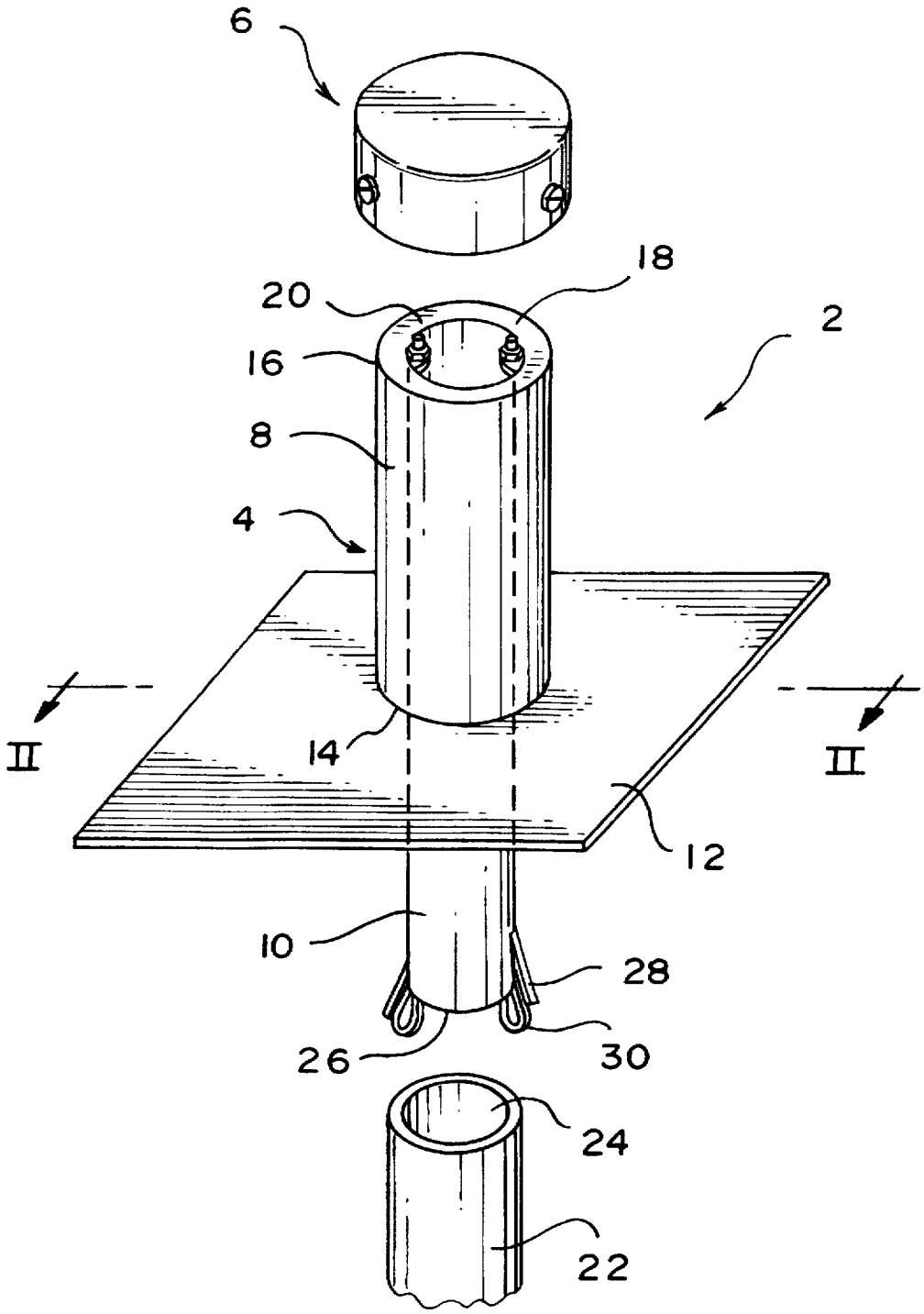
FIG. 1 is an exploded perspective view of the preferred embodiment of the vent extension flashing assembly of the present invention.

Referring now to FIG. 1, an exploded perspective view of the components of the vent extension flashing assembly 2 is illustrated in accordance with a preferred embodiment of the present invention. The vent extension flashing assembly 2 includes a main body portion 4 and a cap 6, both formed of metal or other substantially rigid material. The main body portion 4 includes a cylindrical outer vent cover 8, a cylindrical inner vent cover 10, and a substantially flat roof flashing base plate 12. Roof flashing base plate 12 extends radially outwardly from attachment with a bottom end 14 of cylindrical outer vent cover 8. A closure surface 18 extends between an upper end 16 of the cylindrical outer vent cover 8 and an upper end 20 of the cylindrical inner vent cover 10 to attach vent covers 8 and 10 together. The cylindrical inner vent cover 10 extends from closure surface 18 in spaced relation to cylindrical outer vent cover 8, and the longitudinal lengths of cylindrical vent covers 8 and 10 extend substantially parallel.

The diameters of the vent covers 8 and 10 are of a suitable size such as to allow a vent pipe 22 to extend from a roof (not shown) and to pass between the two vent covers 8 and 10. Therefore, the diameter of cylindrical inner vent cover 10 is slightly smaller than that of the vent pipe 22, while the cylindrical outer vent cover 8 has a diameter larger than that of vent pipe 22. While the preferred embodiment of the present invention is described as having cylindrical vent covers 8 and 10 in order to accommodate the cylindrical shape of typical vent pipes 22, it is understood that vent covers 8 and 10 may comprise any cross-sectional shape to conform to vent pipes of different shapes. The cylindrical inner vent cover 10 is inserted into the vent pipe 22 and moved inwardly until roof flashing base plate 12 abuts the roof surface. The roof flashing base plate 12 is formed to extend substantially parallel to the roof surface. Typically, vent pipes 22 exit a roof surface forming a right angle with the roof surface. In these situations, the plane in which roof flashing base plate 12 extends is perpendicular to the longitudinal length of vent covers 8 and 10. In situations where the vent pipe 22 form an angle other than 90° with the roof surface, the plane in which roof flashing base plate 12 extends will form substantially the same angle with the longitudinal length of vent covers 8 and 10 so as to follow the inclination angle of the roof. The roof flashing base plate 12 will thereby cover a hole formed in the roof allowing the vent pipe 22 to pass therethrough and prevent the flow of external elements through the hole between the vent pipe 22 and roof.

In order to secure the vent extension flashing assembly 2 in place after the vent pipe 22 is positioned within the assembly 2, a plurality of expanders 30 are provided for expanding the inner vent flashing 10 to engage the inner surface 24 of vent pipe 22. At the bottom end 26 of inner vent cover 10, slits are cut through the inner vent cover 10 to form a rigid, but bendable portion 28 in the inner vent cover 10. A bendable portion 28 is formed adjacent to each expander 30. Once the vent extension flashing assembly 2 is positioned in place, the expanders 30 are used in a cam-like manner to expand bendable portions 28 outwardly until they apply a force against the inner surface 24 of vent pipe 22. The frictional engagement between the bendable portions 28 and the inner surface 24 of the vent pipe 22 resulting from the force exerted on inner surface 24 serves to hold inner vent cover 10 in place within the vent pipe 22. Since inner vent cover 10 is rigidly attached to the remainder of the main body portion 4 of vent extension flashing assembly 2, the entire vent extension flashing assembly 2 is held securely in a stationary relationship with respect to vent pipe 22. The plurality of expanders 30 and their respective bendable portions 28 are preferably spaced equidistant from one another around the circumference of the cylindrical inner vent cover 10 in order to balance the radial forces acting on the vent pipe 22.

Figure 2:
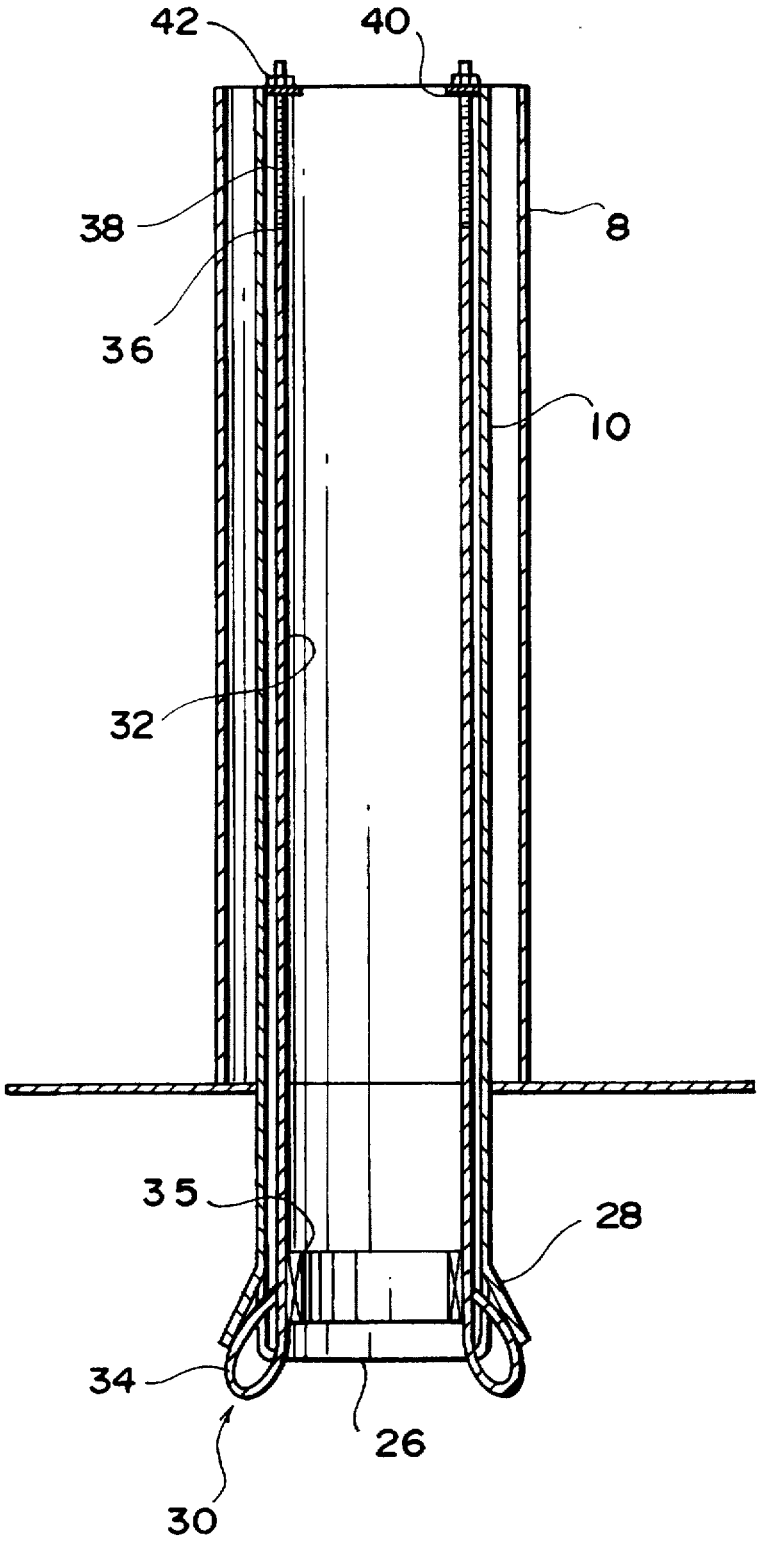
FIG. 2 is a sectional view of a portion of the vent extension flashing assembly of FIG. 1 taken generally along lines II—II.

Referring now to FIG. 2, the structure of expanders 30 will be described in greater detail. Each expander 30 includes a connector strip 32 which extends along the inner surface of inner vent cover 10. The connector strip 32 extends to the bottom end 26 of inner vent cover 10, and the end of the connector strip is bent backward to form a loop 34. A retaining member 35 is attached above the loop 34 to the inner surface of inner vent cover 10 at points on both sides of bendable portion 28, and connector strip 32 extends between retaining member 35 and bendable portion 28. The retaining member 35 maintains the connector strip 32 in close proximity to the inner surface of inner vent cover 10, but permits the connector strip 32 to move longitudinally relative to the inner vent cover. An upper end 36 of connector strip 32 is attached to a threaded take-up bolt 38, or, alternatively, the upper end 36 of the connector strip 32 may be threaded. Take-up bolt 38 extends along the inner surface of inner vent cover 10 to a retaining flange 40 attached to the inner surface at the upper end 20 of the inner vent cover 10. The take-up bolt 38 further extends above the retaining flange 40, and a nut 42 is threaded on the end of take-up bolt 38. When the nut 42 is tightened, it abuts both retaining flange 40 and closure surface 18.

In the above-described structure, the expander 30 is operated by simply tightening take-up nut 42 to draw the take-up bolt 38 upward and thereby move the connector strip 32 longitudinally upward. As take-up nut 42 is tightened, connector strip 32 is drawn upward until loop 34 engages bendable portion 28 of inner vent cover 10. Loop 34 is too large to pass between bendable portion 28 and retaining member 35, and therefore, expander 30 acts like a cam. As loop 34 is continued to be drawn upward, it will force bendable portion 28 outward until bendable portion 28 abuts the inner surface 24 of vent pipe 22. This forced engagement between the bendable portions 28 and the vent pipe 22 serves to retain the vent extension flashing assembly 2 in place.

Normally connector strip 32 and loop 34 will be formed of metal or a material which is more rigid than the material forming the bendable portions 28. However, other cam configurations can replace the loop 34 at the end of the connector strip 32.

The structure of the above-described preferred embodiment allows the vent extension flashing assembly 2 to be securely affixed by simply tightening take-up nuts 42 after the vent extension flashing assembly 2 is positioned over the vent pipe 22. The above-described structure also allows the vent extension flashing assembly 2 to extend the same distance from the surface of the roof for any vent pipe 22 on which the assembly 2 is installed. Since the inner vent cover 10 is inserted into the vent pipe 22 until the roof flashing base plate 12 abuts the roof surface, the outer vent cover 8 will always be the same distance above the roof no matter how far the inner vent cover 10 is inserted into vent pipe 22. Therefore, the vent extension flashing assembly 2 of the present invention allows a uniform distance above the surface of the roof to be achieved for vent pipes 22 protruding varying heights above and below the roof surface.

Figure 3:
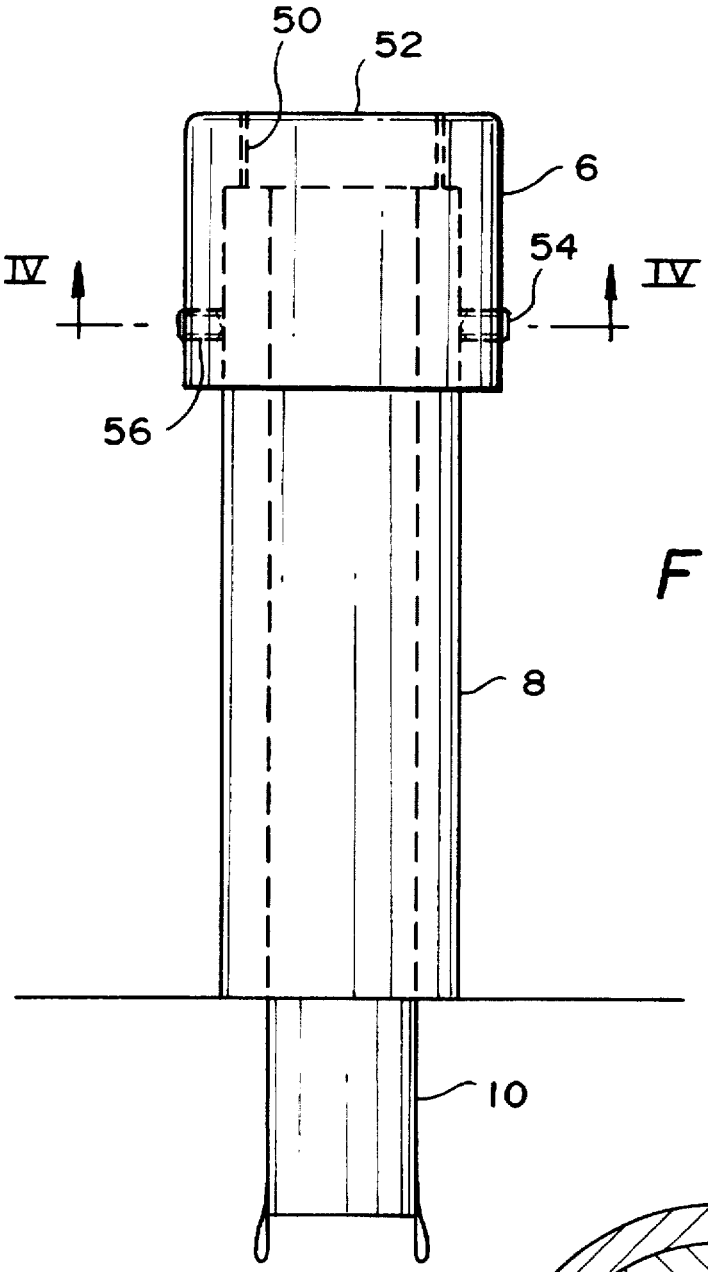
FIG. 3 is a fully assembled front view of the vent extension flashing assembly of FIG. 1.

The vent extension flashing assembly 2 further includes a cap 6 which extends over the closure surface 18 and around the outer surface of an upper portion of outer vent cover 8, as illustrated in FIG. 3. Cap 6 prevents external elements from entering through inner vent cover 10 into vent pipe 22.

However, cap 6 does not provide an air-tight seal over the closure surface 18 in order to allow gaseous fluid to escape from vent pipe 22 and through the upper end 20 of inner vent cover 10. A spacer 50 is positioned within the top surface 52 of the cap 6 to prevent the top surface 52 from abutting against the closure surface 18 when the cap 6 is positioned over the outer vent cover 8. The spacer 50 will abut the closure surface 18 when the cap 6 is in place on the vent extension flashing assembly 2. Spacer 50 provides a gaseous flow path between the cap 6 and the closure surface 18 to allow gaseous fluid to flow through inner vent cover 10 and outside of the vent extension flashing assembly 2.

Figure 4:
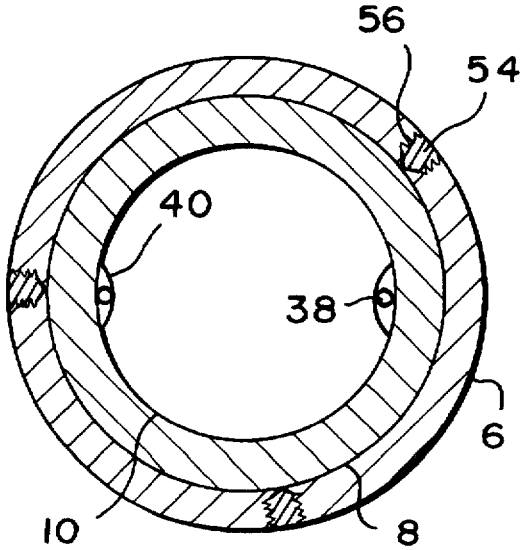
FIG. 4 is a sectional view of a portion of the vent extension flashing assembly of FIG. 3 taken generally along lines IV—IV.

Referring now to FIG. 4, a cross-sectional view of a top portion of the vent extension flashing assembly 2 illustrates that the cap 6 is secured to the outer surface of the outer vent cover 8 using pressure set screws 54 which extend though a threaded apertures 56 in the cap 6 to engage the outer vent cover 8. In order to provide a tamper-proof closure, the screws 54 preferably require use of a special tool to tighten and loosen the cap 6 relative to the outer vent cover 8, such as conventional hex screws or the like. Once the cap 6 is installed in place, it can not be removed without the use of the special tool. Further, the vent extension flashing assembly 2 is locked in place by the expanders 30 which have retained the bendable portions 28 in force fit engagement with the inner vent cover 10. Since cap 6 encloses the upper end 20 of the inner vent cover 10, the vent extension flashing assembly 2 can not be removed from the roof unless cap 6 is first removed. Therefore, the above-described vent extension flashing assembly 2 of the present invention provides a substantially tamper-proof and vandal-proof structure.

As can be seen from the foregoing, a vent extension flashing assembly 2 formed in accordance with the present invention will provide a structure which is easily and quickly installed over a vent pipe protruding through a roof. Furthermore, a vent extension flashing assembly 2 formed in accordance with the present invention will provide a structure which prevent unwanted access to the vent pipe by providing a tamper-proof and vandal-proof structure. Additionally, a vent extension flashing assembly 2 formed in accordance with the present invention provides a structure which extends a uniform distance above the surface of a roof vent pipes protruding varying heights above and below the roof surface.

I claim:

1. A vent extension flashing assembly for covering a vent pipe protruding through the roof of a building, comprising:

a inner vent cover having a longitudinal length with an upper end and a lower end, said inner vent cover having a cross-sectional shape sized to be smaller than that of the vent pipe to allow said inner vent cover to be positioned within the vent pipe;

an outer vent cover having a longitudinal length with an upper end and a lower end, said outer vent cover defining an inner chamber having a cross-sectional shape sized to be larger than that of the vent pipe to allow said outer vent cover to be positioned around the vent pipe;

a closure surface extending between the upper end of said inner vent cover and said upper end of said outer vent cover, wherein said inner vent cover extends within said outer vent cover so that said longitudinal lengths of said inner vent cover and said outer vent cover extend in a substantially parallel direction;

a roof flashing base plate adapted to extend from a bottom end of said outer vent cover in a direction substantially parallel to the roof;

an expandable portion formed on said lower end of said inner vent cover, said expandable portion capable of being expanded to engage an inner surface of the vent pipe and hold the inner vent cover in place within the vent pipe; and an expansion unit mounted on said inner vent cover to expand said expandable portion into engagement with the inner surface of said vent pipe.

2. The vent extension flashing assembly as defined in claim 1, wherein said inner vent cover, said outer vent cover, and said roof flashing base plate are formed as a unitary structure to allow the entire structure to be installed over the vent pipe as a single unit.

3. The vent extension flashing assembly as defined in claim 1, wherein said inner vent cover and said outer vent cover are cylindrical.

4. The vent extension flashing assembly as defined in claim 1, further comprising an end cap which is positioned over said upper ends of said inner and outer vent covers, and means mounted on said end cap to secure said end cap against an upper portion of said outer vent cover.

5. The vent extension flashing assembly as defined in claim 4, wherein said end cap is secured against said outer vent cover using a tamper-proof fastening device.

6. A vent extension flashing assembly for covering a vent pipe protruding through the roof of a building comprising:

an inner vent cover having a longitudinal length with an upper end and a lower end, said inner vent cover having a cross-sectional shape sized to be smaller than that of the vent pipe to allow said inner vent cover to be positioned within the vent pipe;

an outer vent cover having a longitudinal length with an upper end and a lower end, said outer vent cover defining a central chamber having a cross-sectional shape sized to be larger than that of the vent pipe to allow said outer vent cover to be positioned around the vent pipe;

a closure surface extending between the upper end of said inner vent cover and the upper end of said outer vent cover, wherein said inner vent cover extends within said outer vent cover so that said longitudinal lengths of said inner vent cover and said outer vent cover extend in a substantially parallel direction;

a roof flashing base plate adapted to be from a bottom end of said outer vent cover in a direction substantially parallel to the roof;

said inner vent cover, said outer vent cover, and said roof flashing base plate being formed as a unitary structure to allow the entire structure to be installed over the vent pipe as a single piece; and an end cap which is positioned over said upper ends of said inner and outer vent cover, wherein said end cap is secured against an upper portion of said outer vent cover.

7. The vent extension flashing assembly as defined in claim 6, wherein said end cap is secured against said outer vent cover using a tamper-proof fastening device.

* * * * *